US009062530B2

(12) United States Patent
Patel et al.

(10) Patent No.: US 9,062,530 B2
(45) Date of Patent: Jun. 23, 2015

(54) COMPLETION ASSEMBLY

(75) Inventors: Dinesh Patel, Sugar Land, TX (US); Andreea Madalina Tatulescu, Houston, TX (US); Bryan Stamm, Houston, TX (US); Spyro Kotsonis, Missouri City, TX (US); Tom Saunders, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 555 days.

(21) Appl. No.: 13/367,693

(22) Filed: Feb. 7, 2012

(65) Prior Publication Data

US 2012/0199346 A1 Aug. 9, 2012

Related U.S. Application Data

(60) Provisional application No. 61/441,096, filed on Feb. 9, 2011, provisional application No. 61/441,032, filed on Feb. 9, 2011.

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)

(58) Field of Classification Search
USPC ..... 166/278, 373, 375, 319, 205
See application file for complete search history.

(56) References Cited

U.S. PATENT DOCUMENTS

| | | | | |
|---|---|---|---|---|
| 3,741,300 | A | 6/1973 | Wolff et al. | |
| 6,464,006 | B2 | 10/2002 | Womble | |
| 7,222,676 | B2 * | 5/2007 | Patel et al. | 166/378 |
| 7,950,454 | B2 | 5/2011 | Patel et al. | |
| 2006/0157257 | A1 * | 7/2006 | Ross et al. | 166/386 |
| 2007/0227727 | A1 * | 10/2007 | Patel et al. | 166/250.01 |
| 2008/0308274 | A1 | 12/2008 | MacDougall | |
| 2009/0025923 | A1 | 1/2009 | Patel et al. | |
| 2009/0095471 | A1 | 4/2009 | Guignard et al. | |
| 2010/0038093 | A1 * | 2/2010 | Patel | 166/375 |
| 2010/0139909 | A1 * | 6/2010 | Tirado et al. | 166/51 |
| 2010/0175894 | A1 | 7/2010 | Debard et al. | |
| 2010/0300687 | A1 | 12/2010 | Watson et al. | |

* cited by examiner

*Primary Examiner* — Cathleen Hutchins
(74) *Attorney, Agent, or Firm* — Patrick Traister; Brandon Clark

(57) ABSTRACT

A technique includes running a lower completion assembly into a well in a single trip. The lower completion assembly includes a screen, a first valve and a second valve. The technique includes performing a gravel packing operation using the lower completion assembly, where performing the gravel packing operation includes running a service assembly into the lower completion assembly to operate the first valve. The technique further includes removing the service assembly from the well and subsequently installing an upper completion assembly in the well. The installation of the upper completion assembly enables remote control of the second valve of the lower completion assembly for purposes of regulating the production of fluid from the well.

29 Claims, 16 Drawing Sheets

COMPLETION ASSEMBLY

This application claims the benefit under 35 U.S.C. §119 (e) to U.S. Provisional Patent Application Ser. No. 61/441,096 entitled, "SAND CONTROL WITH INTEGRATED INTELLIGENT COMPLETION AND FLOW CONTROL VALVES," which was filed on Feb. 9, 2011, and U.S. Provisional Patent Application Ser. No. 61/441,032, entitled, "INTEGRATED SINGLE TRIP MULTIZONE FRAC PACK AND INTELLIGENT COMPLETION SYSTEM," which was filed on Feb. 9, 2011. Each of these applications is hereby incorporated by reference in its entirety.

BACKGROUND

For purposes of forming a well to extract a hydrocarbon-based fluid (oil or natural gas) from a hydrocarbon-bearing geological formation, a wellbore is first drilled into the formation and completion equipment, which typically includes a complex system of tubes and valves, is installed in the wellbore to regulate the production of well fluid from the well.

The completion equipment may include sand control equipment, such as screens and filtering media, and a production tubing string to communicate well fluid to the Earth surface. Installing the completion equipment, as well as conducting downhole operations associated with completing the well, such as gravel packing and/or fracturing operations, may involve multiple runs, or trips, into the well. In general, each trip into the well may add to the cost and complexity associated with completing the well.

SUMMARY

In an example implementation, a technique includes running a lower completion assembly into a well in a single trip. The lower completion assembly includes a screen, a first valve and a second valve. The technique includes performing a gravel packing operation using the lower completion assembly, where performing the gravel packing operation includes running a service assembly into the lower completion assembly to operate the first valve. The technique further includes removing the service assembly from the well and subsequently installing an upper completion assembly in the well. The installation of the upper completion assembly enables remote control of the second valve of the lower completion assembly for purposes of regulating the production of fluid from the well.

In another example implementation, an apparatus includes a lower completion assembly that includes a screen, a first valve and a second valve, which are adapted to be run downhole as a unit. The first valve is adapted to be controlled by a service tool in a downhole operation, and the service tool is run into the lower completion assembly before installation of an upper completion assembly. The second valve is adapted to be controlled in response to one or more stimuli that are communicated downhole via at least one control line of the upper completion assembly.

In yet another example implementation, an apparatus includes a lower completion assembly that includes a plurality of sections that are adapted to be run downhole in a single trip into a well. The lower completion assembly is adapted to be used during a gravel packing phase to deposit gravel about at least one of the sections and mate with an upper completion assembly after the gravel packing phase to regulate production in a production phase. At least one of the sections includes a screen, a packer, a first valve, a second valve and a circulation valve. The lower completion assembly is adapted to receive a service tool during the gravel packing phase to communicate a gravel slurry and operate the first valve to regulate delivery of the gravel; and the second valve is adapted to be regulated in response to one or more stimuli communicated downhole via at least one control line of the upper completion assembly during the production phase.

Advantages and other features will become apparent from the following drawings, description and claims.

DETAILED DESCRIPTION

In the following description, numerous details are set forth to provide an understanding of embodiments of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. Moreover, the term "sealing mechanism" includes: packers, bridge plugs, downhole valves, sliding sleeves, baffle-plug combinations, polished bore receptacle (PBR) seals, and all other methods and devices for blocking the flow of fluids through the wellbore.

Running an intelligent completion that includes flow control valves inside a screen in a well that are completed using sand control operations (e.g., gravel packing or frac packing operations) may not be commercially attractive, as it may be challenging to run relatively large flow control valves inside a relatively small internal diameter screen. Because of this reason, flow control valves may be run on a separate trip and placed above the screen. However, this arrangement may limit the number of zones (two zones, for example) that may be controlled from a given flow control valve. Completion systems and techniques are disclosed herein to independently control flow from wells having many zones (more than two zones, for example). More specifically, the completion systems that are disclosed herein integrate the flow control valve with the screen and gravel packing operations, which allows independent control of flow from more than two zones in a well, which uses sand control.

Figure 1:
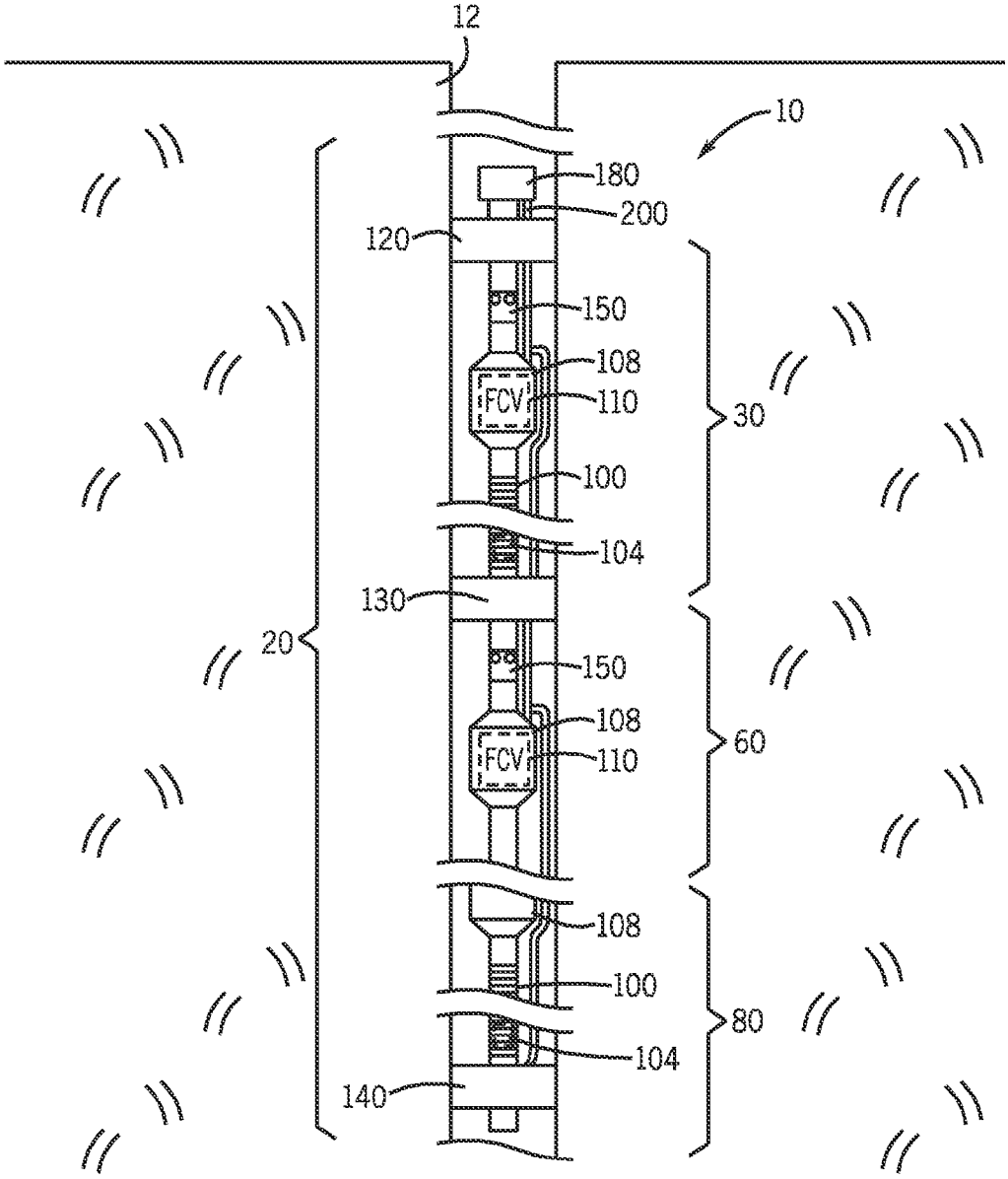
FIG. 1 is a schematic diagram of a well illustrating a single trip, multiple zone lower completion assembly according to an example implementation.

Referring to FIG. 1, a well 10 includes at least one wellbore 12, which extends through one or more hydrocarbon-bearing formations that contain a hydrocarbon-based fluid, such as oil or gas. The wellbore 12 may be cased by a casing string, may be uncased or may contain cased and uncased segments, depending on the particular implementation. Moreover, although the wellbore 12 is depicted as being a vertical wellbore segment, the wellbore 12 may be a lateral wellbore or may contain a lateral wellbore segment, in accordance with other implementations. In general, the well 10 may be a subterranean terrestrial well or may be a subsea well, depending on the particular implementation.

For the example that is depicted in FIG. 1, a lower completion assembly 20 has been installed in a single run, or trip, into the wellbore 12. In this manner, as a non-limiting example, a tubular work string (not shown) may be employed for purposes of running the lower completion assembly 20 downhole from the Earth surface into position and setting one or more packers of the lower completion assembly 20 to secure the assembly 20 in position, as depicted in FIG. 1.

The lower completion assembly 20, in accordance with implementations disclosed herein, includes at least one flow control valve 110 (a cartridge valve, a solenoid-operated valve and/or a control line-operated valve, an electric valve, a hydraulic valve or electro-hydraulic valve as non-limiting examples); one or more circulating, or port control valves 150 (a sleeve valve, as a non-limiting example); one or more return valves 104 (a sleeve valve, as a non-limiting example); and one or more sand production control devices, such as screens 100. As non-limiting examples, the screen 100 may be a wire-wrapped screen, a mesh screen or a sand production control assembly that includes a combination of different filtering media, depending on the particular implementation. Moreover, the screen 100 may be disposed inside a protective shroud (not shown).

In accordance with exemplary implementations, the lower completion assembly 20 may be longitudinally partitioned into sections (exemplary uppermost 30, intermediate 60 and lower 80 sections, being depicted in FIG. 1), which correspond to different segments, or zones, along the wellbore 12. Each section of the lower completion assembly 20 contains components to aid operations involved in completing the associated zone (fracturing, and gravel packing operations, for example) as well as components to regulate the subsequent production of well fluid from the zone.

For example, the uppermost section 30 of the lower completion assembly 20 may include such features as a flow control valve 110, a return valve 104, a screen 100 and a port control valve 150. The uppermost section 30 corresponds to a particular segment, or zone, of the wellbore 12 and extends between an upper gravel packing packer 120 of the lower completion assembly 20 and a lower isolation packer 130, which defines the upper boundary of the next zone and the lower boundary of the zone associated with the section 30. Depending on the particular implementation, the packers 120 and/or 130 may be weight-set packers, mechanically-set packers, inflatable packers, swellable packers, hydraulically-set packers, etc. The screen 100 may longitudinally extend along the wellbore 12 for a distance of several feet to several hundred feet (300 feet, as a non-limiting example), depending on the particular implementation.

In general, the return valve 104 is disposed closer to the lower end of the screen 100 than to the upper end of the screen 100, and as depicted in FIG. 1, may be circumscribed by the screen 100. The return valve 104 may be selectively operated, as further disclosed herein, during a gravel packing and/or fracturing operation for purposes of allowing the return of fluid into the central passageway of the lower completion assembly 20.

More specifically, in accordance with some implementations, all of the return valves 104 (i.e., the return valve 104 of the uppermost completion section 30 and the return valves 104 of the other sections 60 and 80) of the lower completion assembly 20 are initially closed when the assembly 20 is run into the well 10; and the return valves 104 are opened one at a time as the zones are sequentially gravel packed/fractured in an uphole direction. Thus, when it is time to gravel pack and/or fracture the zone associated with the uppermost section 30, for example, the return valve 104 of the uppermost section 30 is opened (via a shifting tool on a service string that is run inside the lower completion assembly 20, for example) to open communication between the central passageway of the section 30 and the surrounding annulus.

Moreover, to gravel pack and/or fracture the zone that is associated with the uppermost section 30, the port control valve 150 of the section 30 is opened (via a shifting tool on a service string, for example) so that a gravel slurry may be communicated from the central passageway of the lower completion assembly 20, through one or more radial ports of the port control valve 150 and into the annulus surrounding the screen 100. In the gravel packing operation, fluid from the slurry exits the slurry, thereby leaving a gravel substrate surrounding the screen 100. This fluid, in turn, returns to the central passageway of the uppermost section 30 through the open return valve 104. It is noted that a service tool string inside the lower completion assembly 20 may include at least one crossover tool for purposes of juxtapositioning flows of the slurry and slurry fluid between the central passageway and annulus of the lower completion assembly 20, as can be appreciated by the skilled artisan.

In accordance with some implementations, the gravel packing operation may be combined with a fracturing operation (in a "frac-pack operation"). Moreover, although gravel packing and fracturing are mentioned herein as examples of downhole operations that may be aided by the components of the lower completion assembly 20, other operations, which may include stimulation operations, acidizing operations, and so forth, may be performed using the lower completion assembly 20, in accordance with other implementations.

Unlike the return valve 104, the flow control valve 110 of the uppermost section 30 is used for purposes of controlling production from the zone that is associated with the section 30. Thus, in general, the flow control valve 110 is not used or controlled during the gravel packing phase and is run into the well 10 initially closed. More specifically, in accordance with exemplary implementations, the flow control valve 110 is constructed to be primarily controlled by one or more control lines 200 to regulate production from the associated zone during the production phase of the well 10. In this manner, one or more control stimuli may be communicated downhole from the Earth surface of the well 10 via the control line(s) 200 during the production phase for purposes of controlling the cross-sectional flow area through the flow control valve 110. As non-limiting example, the stimuli used to control the flow control valve 110 may include hydraulic pressure, hydraulic pressure pulses, electrical stimuli, optical stimuli, acoustic stimuli and so forth; and the control valve 110 has the appropriate telemetry interfaces and actuators to respond to the particular stimuli that are used. During the gravel packing phase, however, a control line communication path does not exist between the lower completion assembly 20 and the Earth surface of the well. As further described below, the control line communication path(s) are completed by one or more control lines of an upper completion assembly, which extends to the Earth surface. Thus, during the gravel packing phase (i.e., before the upper completion assembly is installed), control line operation of the flow control valve 110 is disabled.

Depending on the particular implementation, the flow control valve 110 may have a single open position (associated with a fixed cross-sectional flow area) to permit fluid communication between the central passageway of the section 30 and the annulus; or alternatively, in accordance with other implementations, the flow control valve 110 may have multiple choke positions in which different cross-sectional flow paths may be selected (via the appropriate control line stimuli) between the central passageway and the annulus. Thus, in the former implementation, the flow control valve 110 may be used to permit or isolate a particular zone of the well 10; and in the latter implementation, the flow control valve 110 may be controlled for purposes of isolating flow from the zone if closed or if open, regulating a particular cross-sectional flow area from the associated zone. Moreover, as further described below, in accordance with example implementations, each section of the lower completion assembly 20, such as the section 30, may contain multiple flow control valves 110 that are selectively controlled (some are opened and some are closed, for example) for purposes of regulating the inflow from the associated zone.

As depicted in FIG. 1, in accordance with some implementations, the flow control valve 110 of the uppermost section 30 may be disposed in a radially expanded housing 108 of the uppermost section 30. Due to this design, the flow control valve 110 is capable of regulating a relatively large inflow (as compared to the inner diameter in the non-flow control valve housing sections of the lower completion assembly 20) into the central passageway of the lower completion assembly 20. As further described below, in accordance with some implementations, the housing 108 is part of a sub with three ports, which forms one or more sealed connections for one or more control lines 200 that are inside the housing 108 for purposes of connecting the control lines 200 to the flow control valve 110. Thus, the control lines 200, in general, extend along the exterior of the section 30, as well as extend into the housing 108 for purposes of connecting to the flow control valve 110 inside the housing 108.

Figure 6:
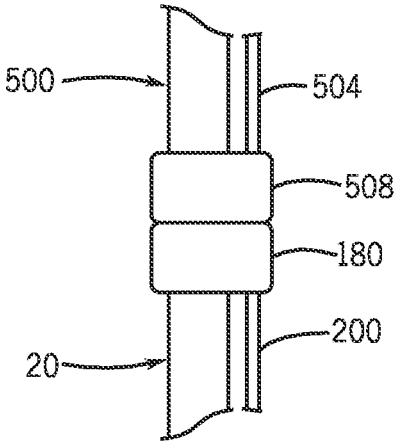
FIG. 6 is a schematic diagram illustrating coupling of the lower completion assembly to an upper completion assembly according to an example implementation.

In accordance with an exemplary implementation, a wet connect coupler 180 is disposed at the upper end of the lower completion assembly 20 for purposes of coupling the control line(s) 200 to one or more corresponding control lines of the subsequently installed upper completion assembly (not shown in FIG. 1). In this manner, referring to FIG. 6 in conjunction with FIG. 1, in accordance with an exemplary implementation, a lower portion 500 of an upper completion assembly may include one or more control lines 504 that, via an associated wet connect coupler 508 that is disposed at the lowermost end of the upper completion assembly, couples to the control line(s) 200. The control line(s) 504, in turn, extend (on the outside of a production tubing string, for example) to the Earth surface or near the Earth surface for purposes of allowing a surface operator to, after installation of the upper completion assembly, remotely control the flow control valve 110. As described below, in accordance with exemplary implementations, the wet connect couplers 180 and 508 schematically represent a collection of wet couplers that may be used to connect one or more control lines together, such as hydraulic lines, electrical lines, optical lines, and so forth.

Referring back to FIG. 1, in addition to the uppermost section 30, the lower completion assembly 20 includes one or more intermediate sections 60 that extend in one or more associated zones, in accordance with exemplary implementations. In general, each intermediate section 60 extends between an isolation packer 130, which is disposed at the upper end of the section 60 and a corresponding isolation packer 130 that is disposed at the lower end of section 60. Moreover, similar to the uppermost section 30, a given intermediate section 60 may include a port control valve 150, a flow control valve 110, a screen 100 and a return valve 104, which are run downhole as a unit with the lower completion assembly 20 and, in general, are arranged and operate similarly to the corresponding components of the uppermost section 30.

In accordance with exemplary implementations, at its lower end, the lower completion assembly 20 includes a lowermost completion section 80 that extends between a given isolation packer (not shown) and a sump packer 140 that is disposed at the lower end of the lower completion assembly 20. In general, the lower section 80 contains components similar to the sections 30 and 60, such as port control valve 150, one or more flow control valves 110, a screen 100 and a return valve 104. Moreover, these elements may be disposed relatively to each other and operate similarly to the components of the sections 30 and 60.

Figure 2:
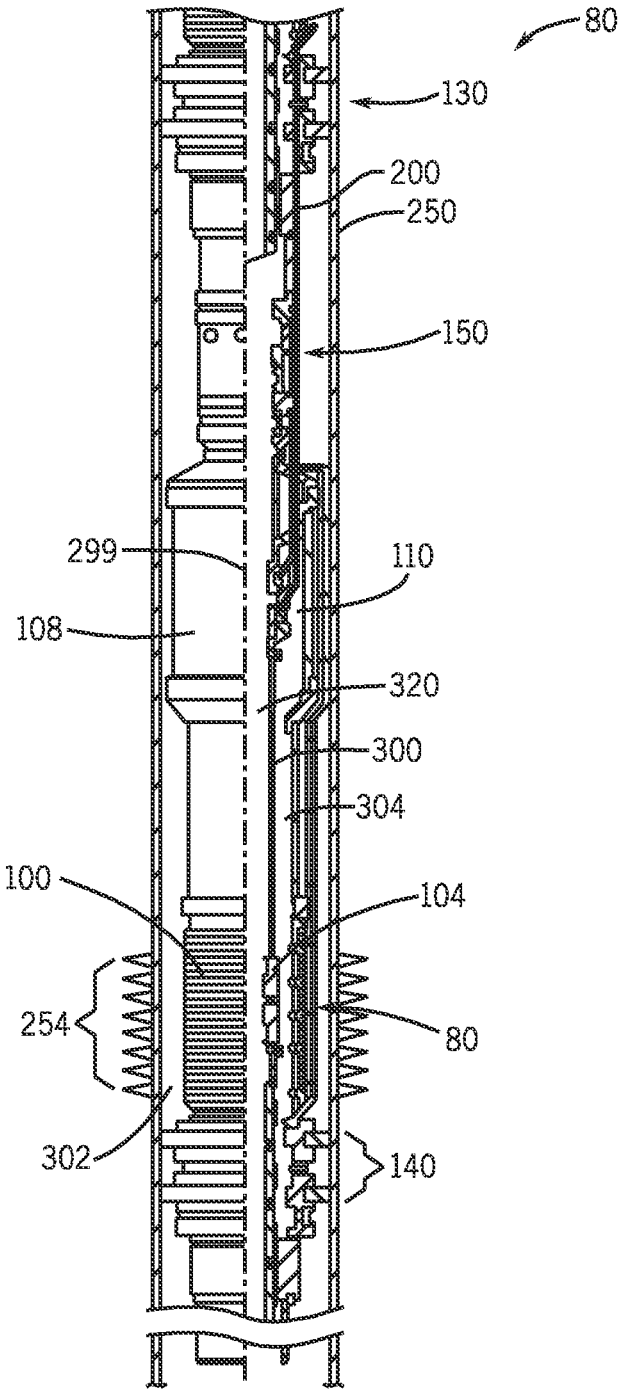
FIG. 2 is a schematic diagram illustrating a lowermost section of the lower completion assembly of FIG. 1 according to an example implementation.

FIG. 2 depicts a more detailed view of the lowermost section 80 in accordance with an exemplary implementation. It is noted that FIG. 2, as well as other figures, schematically depict the lower completion assembly 20 as being generally symmetrically about a longitudinal axis 299, with the view on the lefthand side of the axis 299 being a perspective view and the view on the righthand side of the axis 299 being a cross-sectional view. As shown for this non-limiting example, the lowermost section 80 may be set inside a casing string 250 of the well 10. For this example, the sump packer 140 and an isolation packer 130 are set to form corresponding annular seals between the interior surface of the casing string 250 and the lower completion assembly 20; and as depicted in FIG. 2, for this example, the casing string 250 and surrounding formation have been perforated prior to the running of the lower completion assembly 20 into the wellbore 12 to form corresponding perforation tunnels 254 in the general location of the screen 100.

In general, in accordance with exemplary implementations, the return valve 104 and the flow control valve 110 control inflow fluid communication between the surrounding annulus outside of the lower completion assembly 20 and an inner tubing string 300 of the assembly 20. More specifically, inflow fluid is communicated through the screen 100 and depending on the open/closed states of the valves 104 and 110, is communicated through the valve 104 and/or valve 110 into a central passageway 320 of the lower completion assembly 20. During the gravel packing of the associated zone, a slurry flow is introduced, which flows into an annular region 302 surrounding the screen 100. Fluid from the slurry flow exits through the screen 100 and into an annular region 304 between the screen 100 and the exterior of the tubing string 300, leaving the gravel substrate surrounding the screen 100. Access to the central passageway 320 of the tubing 300 and thus, access to the central passageway of the lower completion assembly 20 is controlled during the gravel packing phase by the return valve 104. Thus, during the gravel packing/fracturing of the zone associated with the section 80 when the return valve 104 is open, fluid flows from the annular region 304 into the central passageway 320 of the tubing 300. Closure of the return valve 104 (such as when the lower completion assembly 20 is run into the well 10 and possibly after gravel packing of the zone is complete) may be accomplished using, for example, a shifting tool that is run inside the lower completion assembly 20. As a non-limiting example, the return valve 104 may be a sleeve valve that has an inner profile that is engaged by a corresponding outer profile (an outer surface of a collet, for example) of a service tool (not shown) that is run inside the central passageway 302.

For the production phase, the upper completion assembly (not shown in FIG. 2) completes the control line communication path(s) to the Earth surface in accordance with exemplary implementations to allow remote control of the flow control valves 110 of the lower completion assembly 20. Thus, during this phase, depending on the particular control settings for the flow control valves 110, the flow control valves 110 selectively permit fluid communication between the annular regions 304 of each zone and the central passageway of the lower completion assembly 20.

Figure 3:
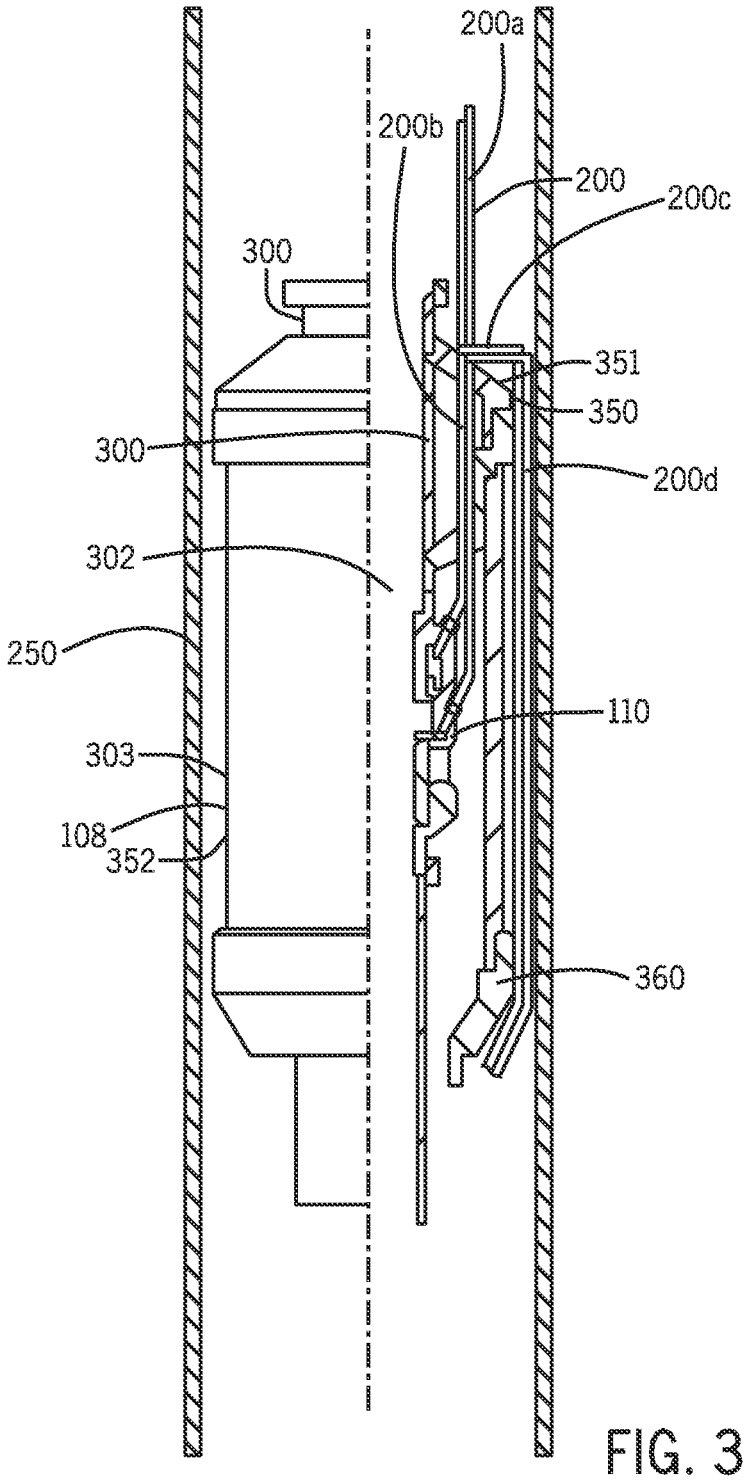
FIG. 3 is a schematic diagram of a flow control valve assembly of FIG. 2 according to an example implementation.
Figure 5:
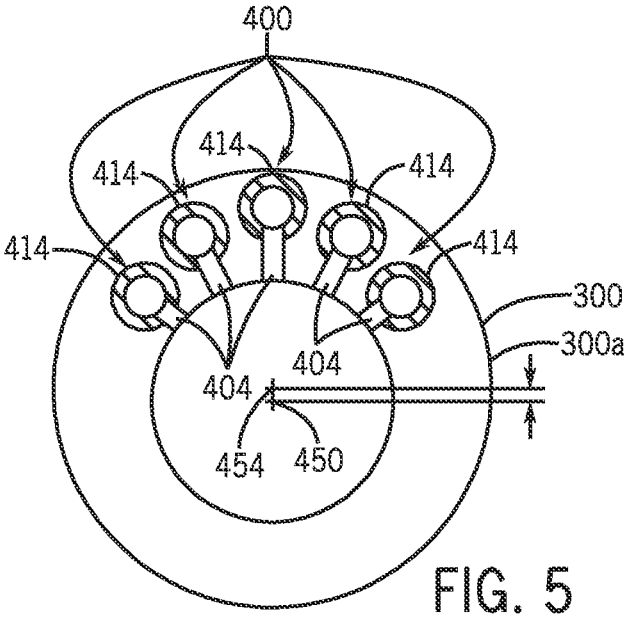
FIG. 5 is a cross-sectional view taken along 5-5 of FIG. 4 according to an example implementation.

Referring to FIG. 3, in accordance with exemplary implementations, the flow control valve 110 is part of a ported flow control valve sub, or assembly 303, which includes the housing 108 and the flow control valve 110. The housing 108 forms connections with the inner tubing string 300; one or more control lines; and an outer section that contains the screen 100. The housing 108 includes an upper cap, or housing section 351, that has one or more control line feedthroughs. In this regard, for the exemplary implementation that is depicted in FIG. 5, the control line(s) 200 include a first segment 200*a* extending uphole from the upper housing section 351; a second segment 200*b* extending from the segment 200*a* through one or more openings of the housing section 351 to the flow control valve 110 that is disposed inside the housing 108; and another segment 200*c* outside of the housing 108, which extends at one or more T junctions between the segments 200*a* and 200*b* and extends downwardly in a segment 200*d* outside of the housing 108. The lower completion assembly 20 may further include protection devices (not shown) for purposes of protecting the control line(s) segments where the control line(s) extend on the outside of the lower completion assembly 20, such as, for example, the segment 200*d*. The housing 108 further includes a radially expand intermediate housing section 352 and a lower cap, or housing section 360.

Figure 4:
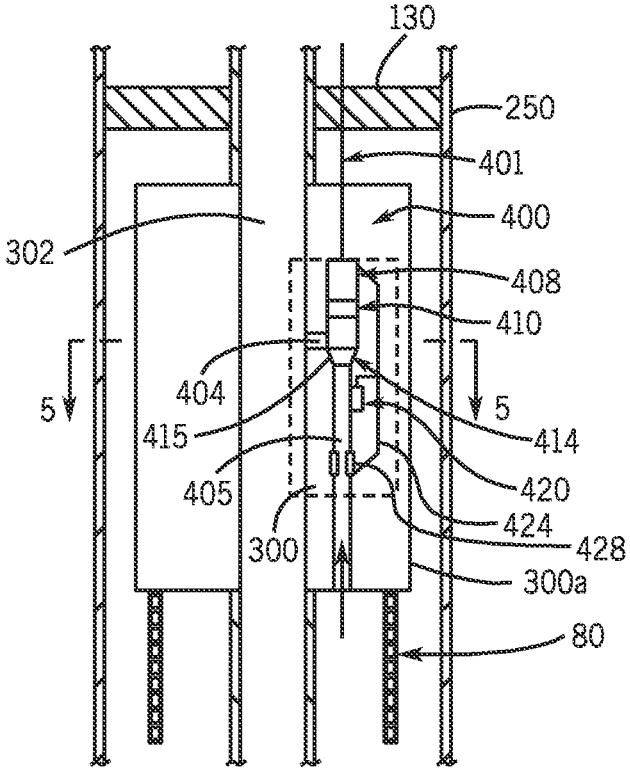
FIG. 4 is a schematic diagram illustrating operation of a flow control valve of the flow control valve assembly of FIG. 3 according to an example implementation.

The flow control valve 110 may have a variety of different designs, depending on the particular implementation. As a non-limiting example, FIG. 4 depicts a flow control valve 400 in accordance with some implementations. For these implementations, the flow control valve 400 is an electrically-controlled valve that has an electric actuator 410 that is controlled by electrical signals that are communicated downhole via an electrical cable 401 (i.e., the "control line" for this example). As shown in FIG. 4, the electric cable 401 passes through the isolation packer 130.

As a non-limiting example, the electrical cable 401 may contain multiple wires for purposes of communicating power and telemetry signals downhole. One or more of the wires of the electrical cable 401 may be used for purposes of communicating telemetry signals uphole. In general, the electrical cable 401 may be coupled (via a wet connect inductive coupler, for example) to control line communication paths of an upper completion assembly. In general, the communication paths of the upper completion assembly may include acoustic paths, wired paths, wireless paths, optical paths, wired pipe paths, electromagnetic communication paths, and so forth, which are coupled to corresponding control line communication paths of the lower completion assembly 20.

In general, signals that are communicated over the electrical cable 401 are received by a power and telemetry module 408 of the flow control valve 400. In this manner, in accordance with some implementations, command-encoded electrical signals may be communicated downhole to the flow control valve 400 via the cable 401 for purposes of selectively actuating the valve 400. This actuation may include, as non-limiting example, fully opening or fully closing the electric flow control valve 400; setting the flow control valve 400 to a particular choke position, closing flow through the electric flow control valve 400; and so forth.

For the example that is depicted in FIG. 4, the electrical actuator 410 controls longitudinal translation of a plunger 414, which, in turn, regulates flow between a longitudinally extending intake passageway 405 and a radial port 404, which are disposed in the tubing string 300. In this manner, as shown in FIG. 4, in accordance with an exemplary implementation, the tubing string 300 includes a section 300*a*, which includes the passageway 405 and the radial port 404 that establishes communication with the central passageway 303, depending on the position of the plunger 414. In this manner, in accordance with exemplary implementations, a tapered lower end of the plunger 414 is configured to mate with a complementary tapered seat 415 that is formed in an upper end of the longitudinal passageway 405 such that when the plunger 414 is fully disposed in the seat 415 (as shown in FIG. 4), fluid communication through the electric flow control valve 400 is closed. However, when the electric actuator 410 longitudinally translates the plunger 414 in an upward direction to remove the lower end of the plunger 414 from the seat 415, fluid communication is established between the radial port 404 and the longitudinal passageway 405. Likewise, longitudinal positions of the plunger 414 may be controlled for purposes of establishing different choke flow positions to selectively establish different cross-sectional flow areas for communicating flow between the annular region and the central passageway 302.

Among its other features, in accordance with an exemplary implementation, the flow control valve 400 may include at least one sensor for purposes of acquiring information pertaining to sensed downhole conditions. This information, in turn, may be communicated uphole via the power and telemetry module 408 using one or more wires of the electrical cable 401 (as a non-limiting example). As non-limiting examples, the flow control valve 400 may include one or more of the following sensors: a pressure sensor, a temperature sensor, a viscosity sensor, and so forth.

By monitoring the data acquired by the sensor(s), an operator at the Earth surface of the well 10 may determine various parameters and control production for a given zone. As a more specific non-limiting example, depicted in FIG. 4, a given sensor 420 may be disposed to sense a property of the fluid in the longitudinal passageway 405; and the electric flow control valve 400 may include a venturi sensor 428 that is disposed about the longitudinal passageway 405 for purposes of acquiring flow velocity measurements. Other and/or different sensors may be employed, in accordance with other implementations. Moreover, in accordance with some implementations, sensors may be disposed on other parts or in other sections of the lower completion assembly 20.

Referring to FIG. 5, in accordance with some implementations, a plurality of flow control devices, such as the electric flow control valves 400 may be peripherally distributed around at least part of the axis of the tubing section 300*a*. For this example, the electric flow control valves 400 are eccentrically disposed (as indicated by offset axes 450 and 454) around a given arcuate segment of the longitudinal axis of the section 300*a* in a "gatling gun" arrangement. With this arrangement, the electric flow control valves 400 may be, for example, selectively fully opened and/or fully closed to establish a desired collective choke position, or cross-sectional flow area, for regulating flow into a given zone. As a non-limiting example, the flow control valves 400 for this implementation may be cartridge valves. In other implementations, the flow control valves 400 may be controlled to have selectable variable cross-sectional flow areas.

Figure 7:
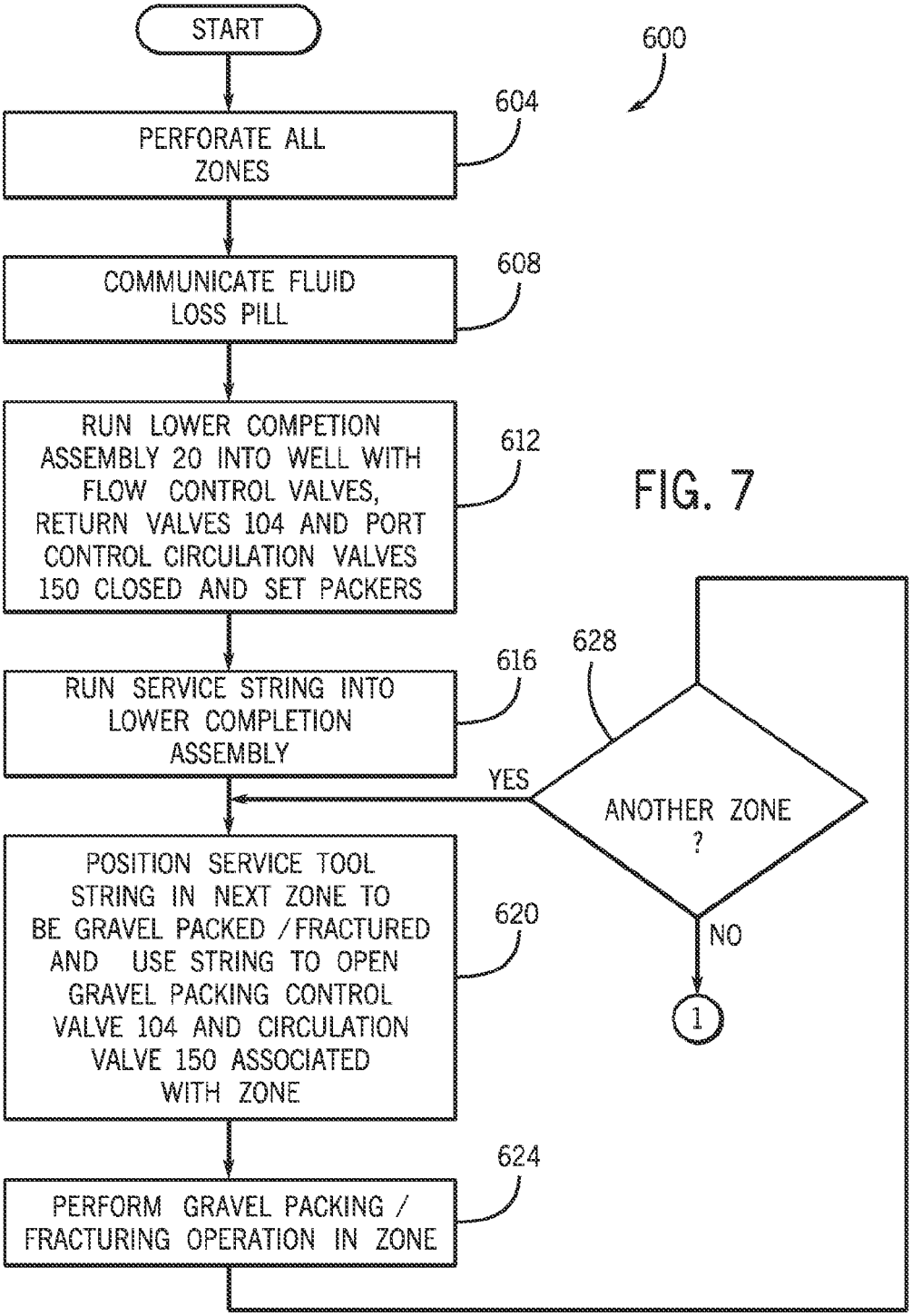
FIGS. 7 and 8 illustrate a flow diagram of a technique to install and use a lower completion assembly and an upper completion assembly according to an example implementation.

Referring to FIG. 7, in accordance with an exemplary implementation, a technique 600 may be used in connection with the lower completion assembly 200 for purposes of completing a well and transitioning the well to a production phase. Pursuant to the technique 600, the zones of the well 10 are first perforated (block 604) and then, a fluid loss pill may be communicated into the well 10, pursuant to block 608. The lower completion assembly 20 is then run into the well 10 with the flow control valves 110, the return valves 104 and the port control valves 150 closed; and the packers of the lower completion assembly 20 are then set, pursuant to block 612. In this manner, the lower completion assembly 20 may be run into the well 10 on a tubular string, in accordance with some implementations.

Next, according to the technique 600, a service string is run into the lower completion assembly, pursuant to block 616. In further implementations, the service string may also be the string that is used to run the lower completion assembly 20 into the well 10 and may be released from the lower completion assembly 20 to allow the service tool(s) of the service tool assembly 20 to perform downhole operations, manipulate valves of the assembly 20, and so forth. In general, each service tool of the service tool string may include one or more collets that have predefined profiles for purposes of engaging the return valves 104 and port control valves 150 to selectively control the opening and closing of these valves, in accordance with some implementations. The service string may further include a tubular string that extends uphole to the Earth surface of the well for purposes of communicating fluids and/or gravel-laden slurry downhole for purposes of using the lower completion assembly 20 to perform such operations as a gravel packing operation, a fracturing operation, a combined gravel packing and fracturing operation, a stimulation operation, an acidizing operation, and so forth.

As an example, the technique 600 next includes performing the gravel packing phase in which the zones are gravel packed (or concurrently fractured and gravel packed, depending on the implementation), beginning with the lowermost zone and proceeding uphole in a sequential fashion. In this manner, the service tool string is positioned (block 620) in the next zone to be gravel packed/fractured and used to open the return valve 104 and port control valve 150 associated with the zone. Next, the gravel packing operation is performed (block 624) in the zone. In other words, the gravel slurry is communicated through the service string and via the appropriate port control valve 150 into the annular region that surrounds the screen 100 such that excess fluid is communicated through the screen 100 and returns to the Earth surface. In accordance with some implementations, the gravel packing operation may be associated with a fracturing operation in which an increased fluid pressure is used for purposes of fracturing the zone.

Figure 8:
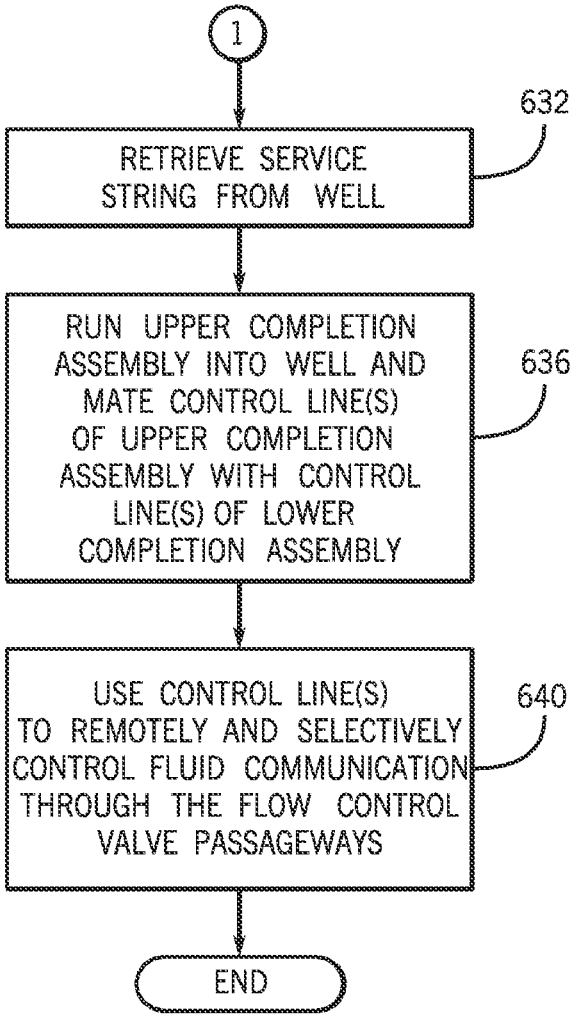

According to the technique 600, if, pursuant to decision block 628 another zone is to be gravel packed/fractured, then control returns to block 620 in which the service tool is re-positioned and manipulated accordingly to open and close the appropriate valves and deliver the slurry flow. Referring to FIG. 8, otherwise, at the end of the gravel packing phase, the service string is retrieved (block 632) from the well 10 and the upper completion assembly is then run (block 636) into the well to mate the control line(s) of the upper completion assembly with the control line(s) of the lower completion assembly. The control line(s) of the upper and lower completion assemblies may then be used to selectively control fluid communication through the flow control passageways of the flow control valves 110 for the production phase, pursuant to block 640.

Figure 9:
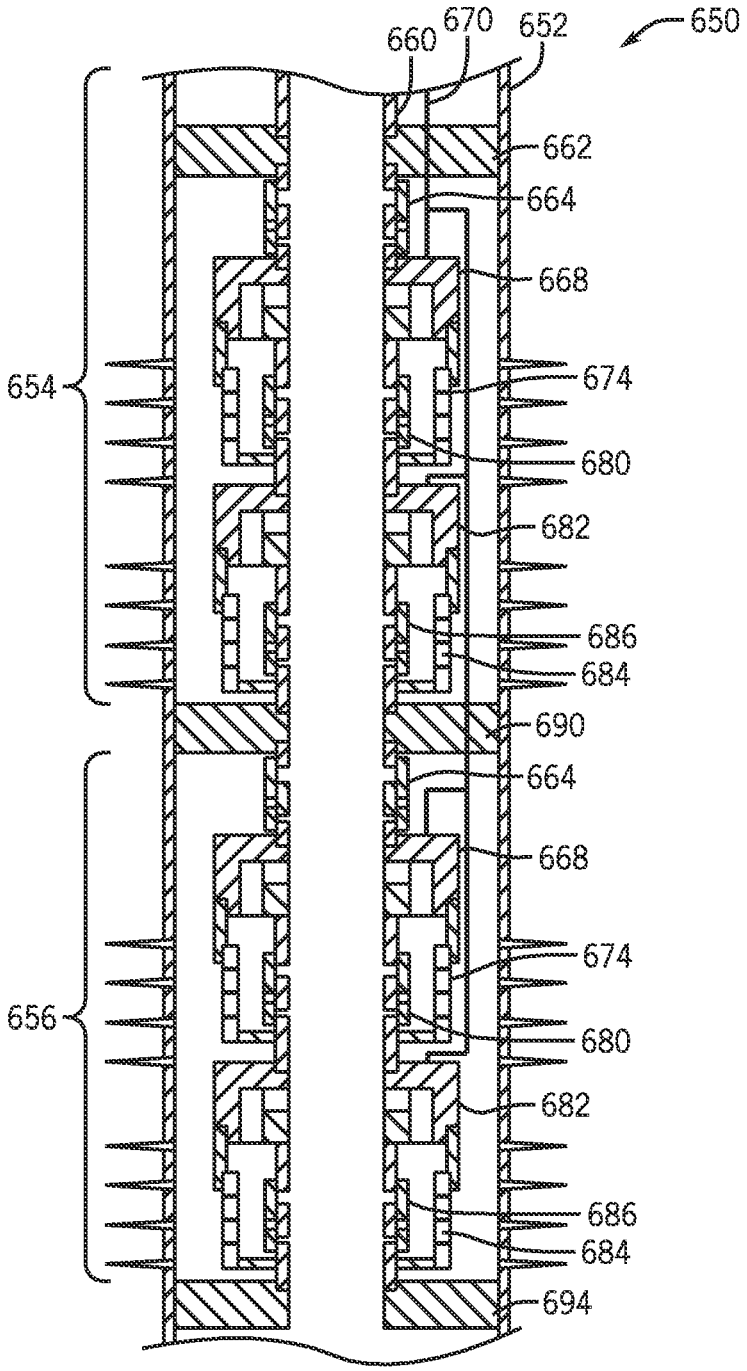
FIG. 9 is a schematic diagram of a single trip, multiple zone lower completion assembly that may be used in downhole fracturing and/or gravel packing operations according to an example implementation.

As a more specific example, FIG. 9 depicts a single trip, multiple zone lower completion assembly 650 that may be used in connection with gravel packing and fracturing operations, in accordance with some implementations. For this example, the lower completion assembly 650 is installed in a cased section of a wellbore, which is cased by a corresponding casing string 652; and the lower completion assembly 650 extends into two exemplary cased zones 654 and 656. It is noted that the lower completion assembly 650 may extend through more than two zones, depending on the particular implementation.

For the example that is depicted in FIG. 9, an upper zone 654 is formed between isolation packers 662 and 690 of the lower completion assembly 650; and a lower zone 656 is formed between the isolation packer 690 and a lower isolation packer 694. The components of the lower completion assembly 650, such as the packers 662, 690 and 694 are generally disposed on an inner tubing string 660 of the assembly 650.

Moreover, for this example, the lower completion assembly 650 includes multiple flow control valves 668 for each zone; and these multiple flow control valves are longitudinally distributed along the zone.

In this manner, as depicted in FIG. 9, in the upper zone 654, the lower completion assembly 650 includes an upper flow control valve 668 and a lower flow control valve 682 that is disposed below the upper flow control valve 668. The upper flow control valve 668 may be operated after the installation of an upper completion assembly (not shown in FIG. 9) for purposes of regulating flow through a screen 674 of the lower completion assembly 650 and an inner, central passageway of the tubing string 660, as described above. Likewise, the lower fluid control valve 682 in the zone 654 may be operated when the upper completion assembly is installed for purposes of regulating communication of a flow through a corresponding screen 684 into the central passageway of the tubing string 660.

The tubing string 660 of the lower completion assembly 650 further includes a port control valve 664 (a sleeve valve, for example) for the upper zone 654, which may be operated by a shifting tool (not shown in FIG. 9) of a service string for purposes of performing a gravel packing operation, a fracturing operation, a stimulation operation, an acidizing operation, and so forth for the zone 654. Moreover, tubing string 660 may further include return valves (sleeve valves, for example) 680 and 686, which are disposed to regulate flow through the screens 674 and 684, respectively, during gravel packing operations for purposes of receiving slurry fluid into the central passageway of the tubing string 660. As also depicted in FIG. 9, the lower completion assembly 650 may include at least one control line 670 (an electrical cable, a hydraulic control line, and so forth), which extends to the flow control valve 668 and 682, as described above, for purposes of controlling the flow control valves 668 and 682 during the production phase of the well.

In general, the lower completion assembly 650 has a similar design and employs similar components (denoted by similar reference numerals) for the lower zone 656, in accordance with example implementations.

Figure 10:
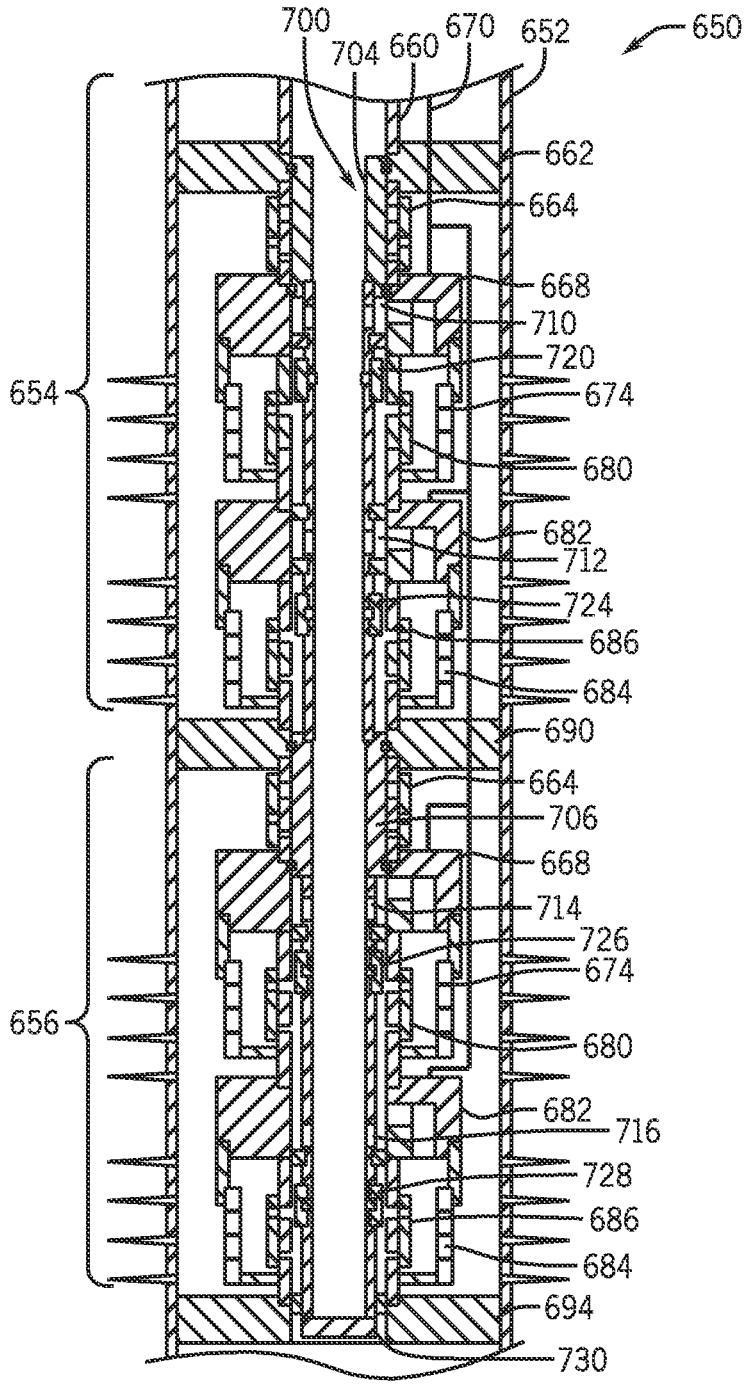
FIG. 10 is a schematic diagram of the lower completion assembly of FIG. 9 after an isolation straddle seal assembly is run into the lower completion assembly according to an example implementation.

During gravel packing, fracturing operations or stimulation operations, and so forth, the port control valves 664 may be selectively opened and closed for purposes of communicating a flow between the central passageway of the tubing string 660 and an annular region in the appropriate zone 654, 656. After these operations are complete and the port control valves 664 are closed, it may be particularly challenging to maintain seals through the closed port control valves 664. Therefore, referring to FIG. 10, in accordance with some implementations, an isolation straddle seal assembly 700 may be run inside the lower completion assembly 650 to provide more effective fluid seals for the closed port control valves 664, as well as allow additional, backup control of the lower completion assembly 650 during the production phase. In general, FIG. 10 depicts the lower completion assembly 650 after the isolation straddle seal assembly 700 has been run into and installed inside the inner tubing string 660 of the lower completion assembly 650.

The isolation straddle seal assembly 700 includes sections, such as exemplary sections 704 and 706, which form corresponding seals to seal off the port control valves 664 from the central passageway of the tubing string 660. Thus, as shown in FIG. 10, in general, each section 704, 706 may contain a sleeve with corresponding seals (o-rings, for example), which straddle the port control valves 664 for purposes of sealing off (and thereby preventing any possible leakage through) the closed valves 664.

The isolation straddle seal assembly 700 also includes, in accordance with exemplary implementations, radial ports 710, 712, 714 and 716 (depicted as examples), which align with the corresponding outlets of the flow control valves 668 to thereby permit fluid communication through the flow control valves 664 and the central passageway of the tubing string 660, as selectively controlled by the states of the flow control valve 664.

In accordance with exemplary implementations, the isolation straddle seal assembly 700 may further include valves 720, 724, 726 and 728 (depicted as non-limiting examples), such as sleeve valves, which provides backup control in case one or more of the flow control valves 664 stop properly functioning (fail closed, for example). In this regard, as depicted in FIG. 10, the valves 720, 724, 726 and 728 are generally aligned with corresponding return valves 686 of the lower completion assembly 650.

For the example implementation that is depicted in FIG. 10, the bottom end of the isolation straddle seal assembly 700 includes a return valve shifting tool 730 that is constructed to shift the return sleeves 680 open as the assembly 700 is run into the lower completion assembly 650. In this regard, as an example, the shifting tool 730 may have a collet with an outer profile that corresponds to an inner profile of the return valves 664 for purposes of engaging the return valves 664 in a sequential manner to open the return valves 664 as the isolation straddle seal assembly 700 is run into the lower completion assembly 650. Thus, when the isolation straddle seal assembly 700 has been fully run into the lower completion assembly 650, as depicted in FIG. 10, all of the return valves 664 are open, but fluid communication into the central passageway of the tubing string 660 is controlled by the valves 720, 724, 726 and 728.

Initially, the valves 720, 724, 726 and 728 are closed, if the corresponding flow control valves 668 operate properly. However, if a particular flow control valve 668 should fail and not be able to be opened or adjusted to the proper setting, the corresponding valve 720, 724, 726 or 728 may be opened (shifted open by a corresponding shifting tool, for example) to establish communication in an alternative path.

Figure 11:
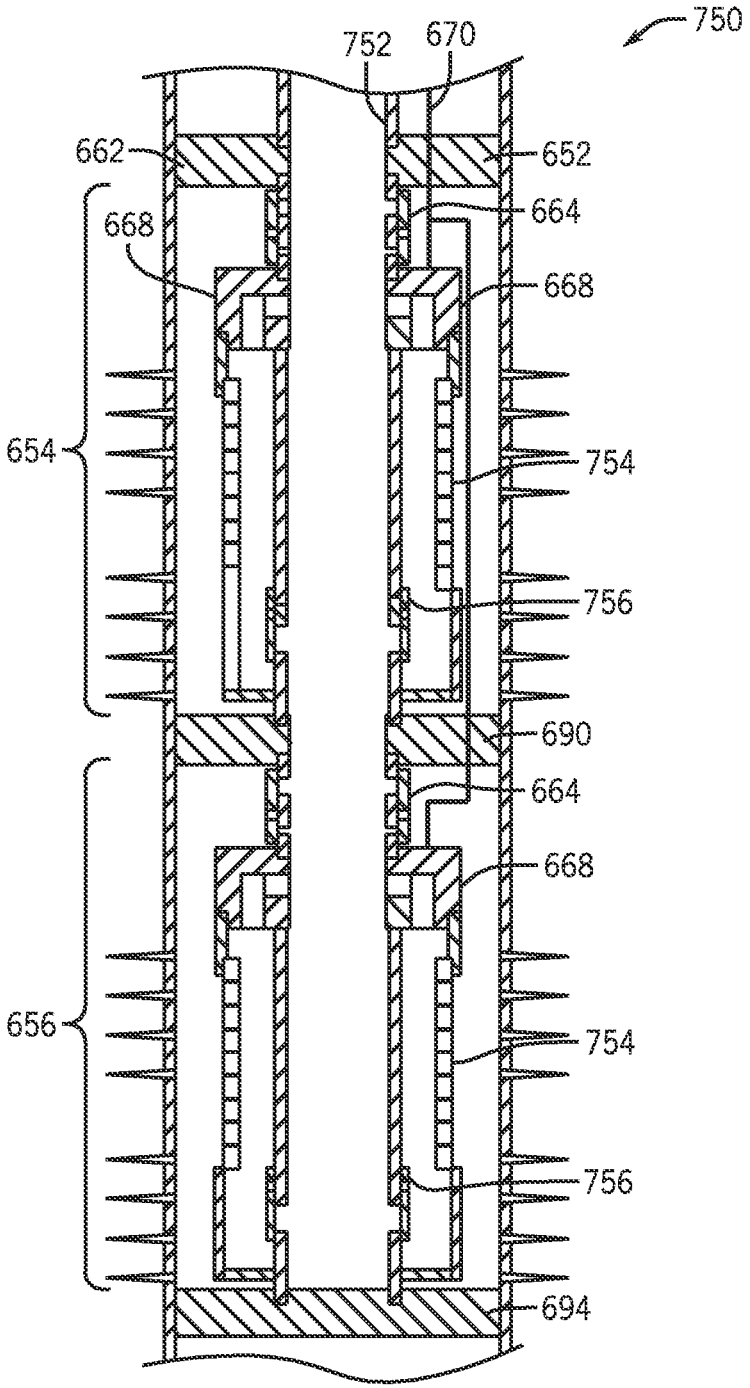
FIG. 11 is a schematic diagram of a single trip, multiple zone lower completion assembly that may be used in fracturing and/or gravel packing operations according to a further example implementation.

Referring to FIG. 11, in accordance with further implementations, a lower completion assembly 750 may be used in place of the lower completion assembly 650 (see FIG. 9, for example). The lower completion assembly 750 has multiple flow control valves 668 per zone, with the flow control valves 668 being arranged around the periphery of an inner tubing string 752 of the lower completion assembly 750, similar to the arrangement depicted in, for example, FIG. 5. As also depicted in FIG. 11, unlike the lower completion assembly 650, the lower completion assembly 750 has a single screen assembly 754 (a screen and shroud, for example) per zone or multiple screen joints connected with flow passage between joint directing flow from all screen joints to flow control valve 668. Moreover, the lower completion assembly 750 has a single return valve 756 per zone.

Figure 12:
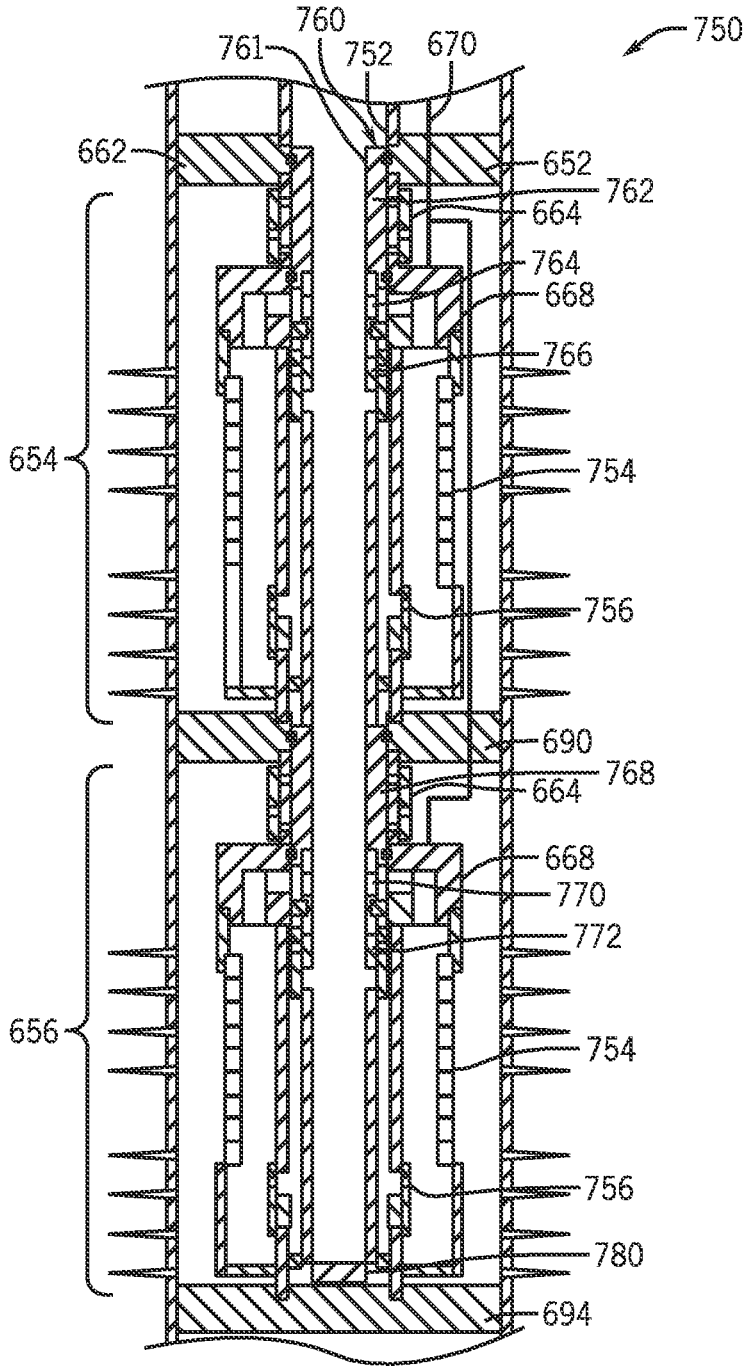
FIG. 12 is a schematic diagram of the lower completion assembly of FIG. 11 after an isolation straddle seal assembly is run into the lower completion assembly according to an example implementation.

Referring to FIG. 12 in conjunction with FIG. 11, an isolation straddle seal assembly 760 may be run into the lower completion assembly 750 after fracturing and gravel packing and/or other operations are complete to prepare the lower completion assembly 750 for production. Similar to the isolation straddle seal assembly 700 (see FIG. 10, for example), the isolation straddle seal assembly 760 includes sections 762 and 768, which seal off the port control valves 664 of the upper 654 and lower 656 zones, respectively.

Moreover, in addition to the sections 762 and 768, an inner tubing string 761 of the isolation straddle seal assembly 760 has ports 764 and 770, which are aligned with the flow control valve 664. Additionally, similar to the isolation straddle seal assembly 700, the isolation straddle seal assembly 760 includes valves 766 and 770 (sliding sleeve valves, for example), which are used as backup valves to selectively provide alternative paths for the return valves 756 of the upper 654 and lower 656 zones, respectively. In this manner, the isolation straddle seal assembly 760 includes a return valve shifting tool 780 at the lower end of the tubing string 761 for purposes of opening the port control valve 664 when the assembly 750 is run into the lower completion assembly 760.

Figure 13:
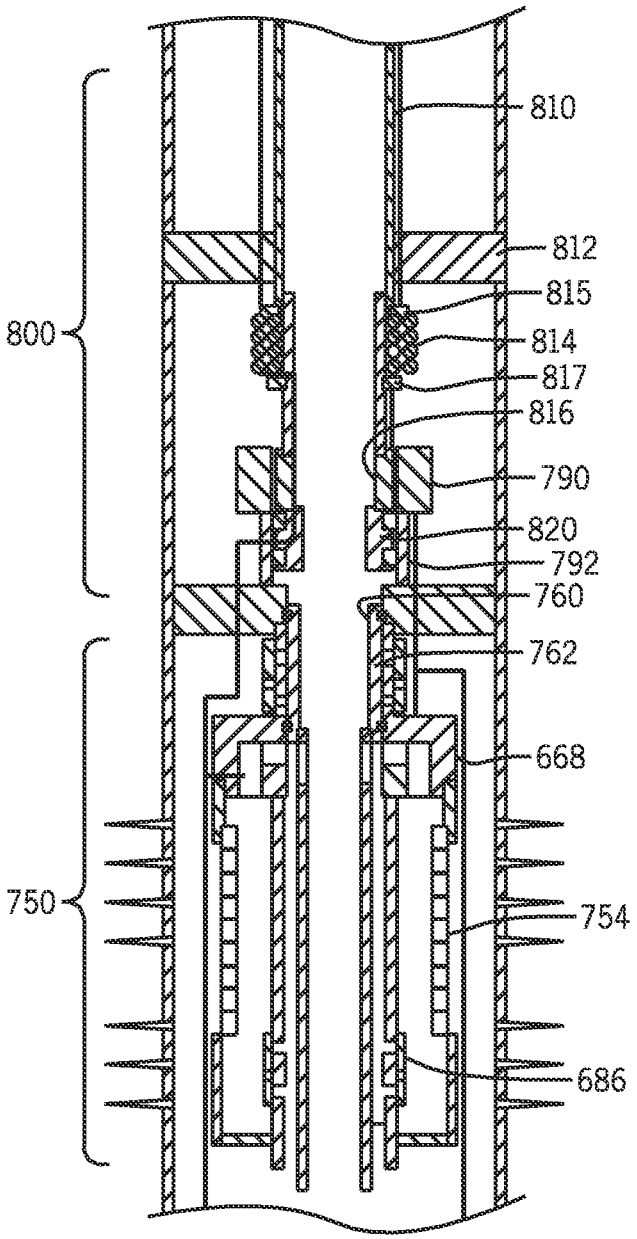
FIG. 13 is a schematic diagram of upper and lower completion assemblies according to an example implementation.

Referring to FIG. 13, using the lower completion assembly 750 of FIG. 12 as a non-limiting example, an upper completion assembly 800 may be subsequently run into the well to mate with the lower completion assembly 750 to enable the flow control valves 668 to be controlled from the Earth surface as well as otherwise configure the lower completion assembly 750 to be used during the production phase. The upper completion assembly 800 includes a production tubing string 810, which extends upwardly to communicate produced well fluid to the Earth surface. Because the production tubing string hanger and lower completion assembly 750 present corresponding fixed connection points, the upper completion assembly 800 includes a contraction joint 814 to provide a degree of movement and flexibility for mating the upper completion assembly 800 with the lower completion assembly 750. In this manner, as depicted in FIG. 13, the upper completion assembly 800 includes a lower tubular section 815 that is mounted to the upper side of the contraction joint 814; and the upper end of the lower completion assembly 750 is attached to the lower end of the contraction joint 814.

Among its other features, the upper completion assembly 800 includes an inductive coupler 816, which is constructed to inductively couple wires of an electric cable 811 that is in communication with the Earth surface to the corresponding wires of the electrical cable 670. For implementations in which the electrical cable is not employed (one or more hydraulic control lines, for example, are alternatively used), the upper completion assembly 800 may not include the inductive coupler 816. When used, the inductive coupler 816 inductively couples the electrical signals to a corresponding inductive coupler 790 located at the upper end of the lower completion assembly 750, as depicted in FIG. 13. Alternately an electrical wet connect in place of inductive coupler may be used.

In addition to or in replacement of the inductive couplers 816 and 790, in accordance with some implementations, the lower end of the upper completion assembly 800 includes a hydraulic wet connect coupler 820 that is disposed below the inductive coupler 816 (if used) to connect one or more hydraulic lines that extend to the Earth surface to one or more hydraulic lines that extend downhole to components of the lower completion assembly 750. As non-limiting examples, these components may include one or more flow control valves 668. As depicted in FIG. 13, the hydraulic wet connect coupler 820 forms a connection with a corresponding hydraulic wet connect coupler 792 of the lower completion assembly 750, which is disposed at the upper end of the lower completion assembly 750.

Figure 14:
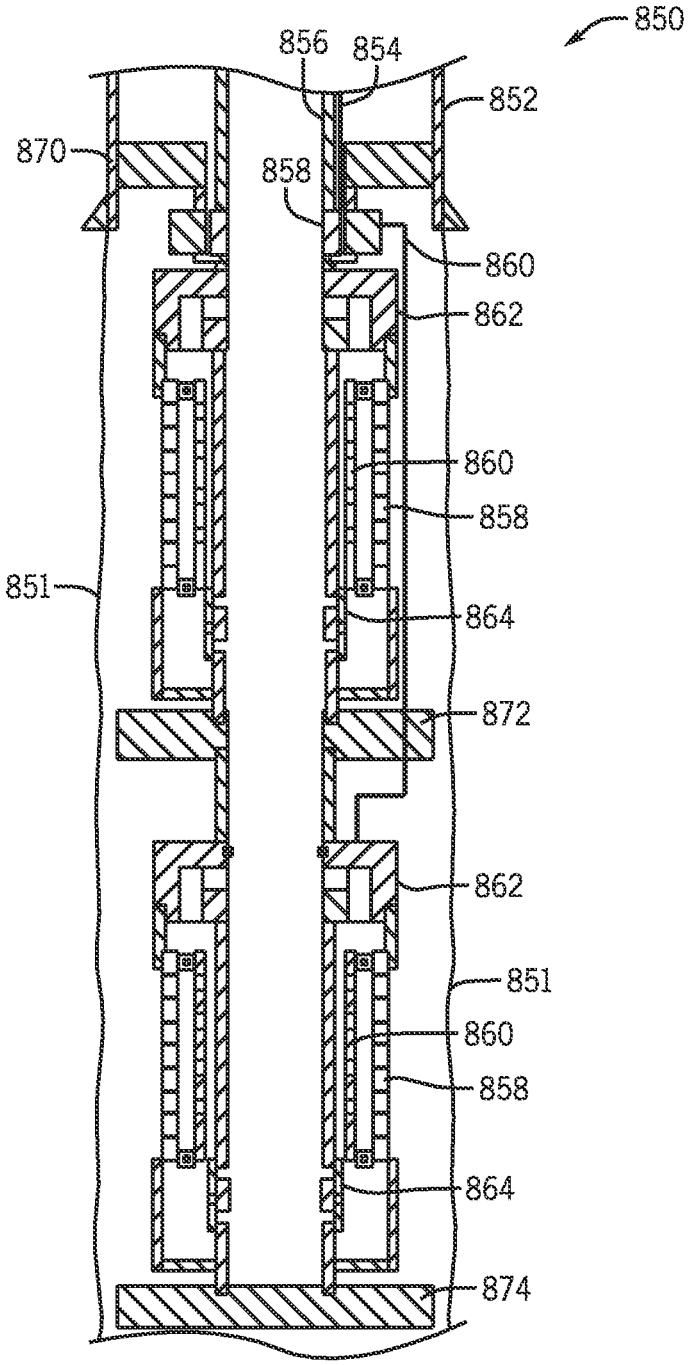
FIG. 14 is a schematic diagram of a single trip, multiple zone lower completion assembly that has a standalone screen assembly according to an example implementation.

Referring to FIG. 14, in further implementations, a lower completion assembly 850, which employs use of standalone screen assemblies, may be run downhole to extend inside an uncased wellbore segment 851. For these implementations, the lower completion assembly 850 may include an inner tubing string 856, which includes packers 870, 872 and 874 for purposes of establishing multiple zones into which the standalone screen assemblies extend. Thus, as depicted in FIG. 14, the upper packer 870 is set inside the casing string 852, with the remainder of the lower completion assembly 850 extending into the uncased wellbore segment 851.

In general, the inner tubing string 856 may include an inductive coupler assembly 858 for purposes of communicating signals from an electrical cable 854 to downhole components of the lower completion assembly 850, such as flow control valves 862. In general, each zone may include multiple flow control valves 862, which, in accordance with some implementations, are arranged around the periphery, as depicted in FIG. 5. Thus, in a given zone, the inner tubing string 856 may contain an arrangement of peripherally-disposed flow control valves 862, which may be selectively operated to control flow of fluid that flows through an associated screen assembly into the central passageway of the tubing string 856. In general, the screen assembly may include an outer shroud 858 and an inner screen 860.

Inside a given zone, the tubing string 856 may further include a return valve 864 (a sleeve valve, for example), which provides an alternative path to regulate flow communication (via a shifting tool, for example), should the flow control valves 862 of the zone fail or not operate properly. With the standalone screen assembly arrangement, it is noted that a gravel packing operation may not be performed. In general, the packers 872 and 874 may be open hole isolation packers, such as swellable packers, hydraulically-set packers, mechanically-set packers and so forth. In further implementations, electric power may be used to activate swelling of the packers 872 and 874. Thus, many variations are contemplated, which are within the scope of the appended claims.

Figure 15:
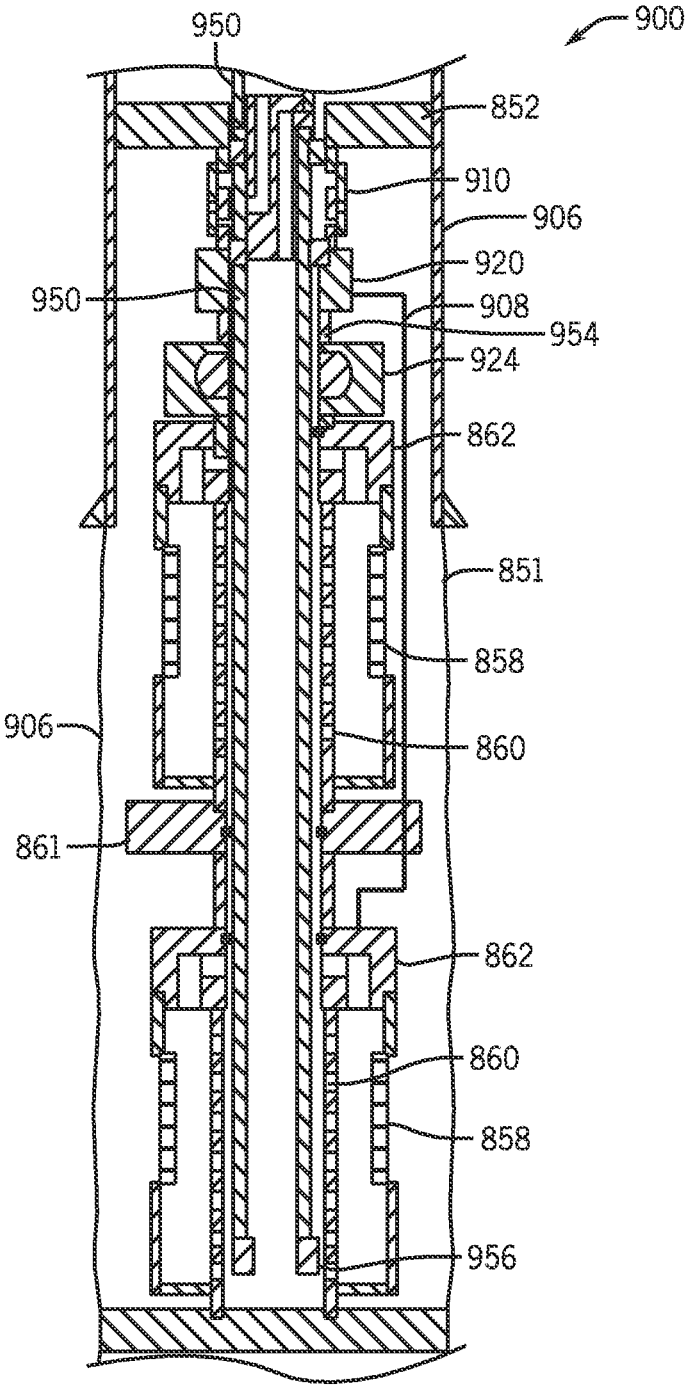
FIG. 15 is a schematic diagram of a single trip, multiple zone lower completion assembly that may be used in gravel packed open hole completion according to an example implementation.

Referring to FIG. 15, in further implementations, a lower completion assembly 900 may be used as part of an open hole gravel packing assembly. In this regard, the lower completion assembly 900 includes an inner tubing string 954, which includes a gravel pack packer 852 that forms an annular seal inside a casing string 852. In general, the lower completion assembly 900 extends from the lower end of the casing section 852 into an uncased wellbore segment 906. The lower completion assembly 900 includes multiple screen assemblies (two screen assemblies being depicted in FIG. 15), which each includes an outer shroud 858 and an inner screen 860. As shown in FIG. 15, the two depicted screen assemblies are separated by an open hole isolation packer 861, such as a swellable packer, a hydraulically-set packer, a mechanically-set packer, and so forth. Gravel packing shunt paths may extend through the packer 861. The lower completion assembly 900 further includes a port control valve 910, which is part of the inner tubing string 901 and is disposed above the screen assemblies.

In general, the lower completion assembly 900 is used to pack gravel around all of the screens in one operation. In this regard, initially, after the gravel pack packer 852 is set, the open hole isolation packer 861 remains unset, so that gravel pack slurry that is communicated inside an inner washpipe 950 via a gravel pack service tool 954 may be communicated through the port control valve 910 and into the annular region between the borehole segment wall 851 and the screen assemblies. Slurry fluid from the gravel packing operation returns through the sleeves and corresponding flow control valves 862 into the central passageway of the washpipe 950.

Figure 16:
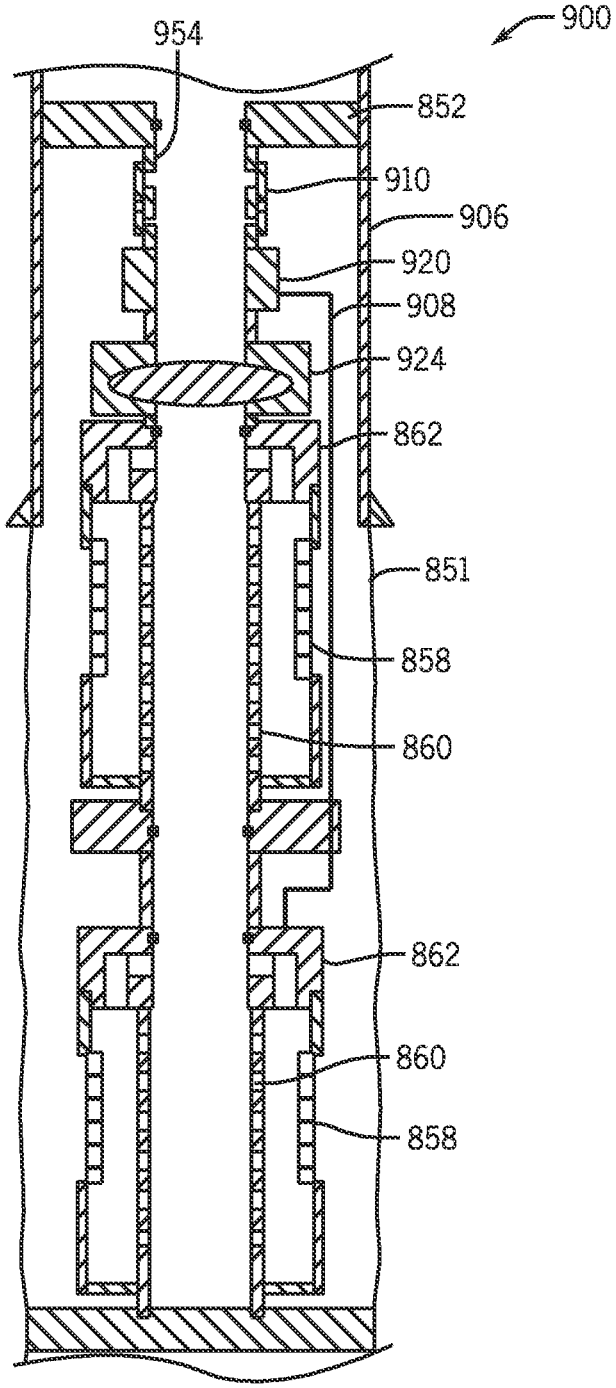
FIG. 16 is a schematic diagram illustrating the lower completion assembly of FIG. 15 after the use and subsequent retrieval of a service tool string according to an example implementation.

As depicted in FIG. 15, the lower completion assembly 900 includes a formation isolation valve 924, which is part of the tubing string 901 and in the particular example implementation that is depicted in FIG. 15 is disposed above the flow control valves 862. For the gravel packing operation, the formation isolation valve 924 is open, which permits entry of a washpipe 861 during the gravel packing operation as well as communication of the returning slurry fluid to the gravel pack service tool 954. Referring to FIG. 16 in conjunction with FIG. 15, at the conclusion of the gravel packing operation, the washpipe 950 and gravel pack service 954 are withdrawn; and the formation isolation valve 924 is closed, thereby isolating the region below the formation isolation valve 924.

As a non-limiting example, the formation isolation valve 924 may be a mechanically-control valve (controlled via a shifting tool, for example), in accordance with some implementations. In this manner, referring to FIG. 16, in accordance with some implementations, the washpipe 950 may include a formation isolation valve shifting tool 956 at its lower end for purposes of controlling the open and closed states of the formation isolation valve 924. As a non-limiting example, the formation isolation valve shifting tool 956 may contain a collet that has a profile that corresponds to an inner profile of the formation isolation valve 924 so that manipulation of the washpipe 950 may be employed for purposes of selectively opening and closing the formation isolation valve 924.

Figure 17:
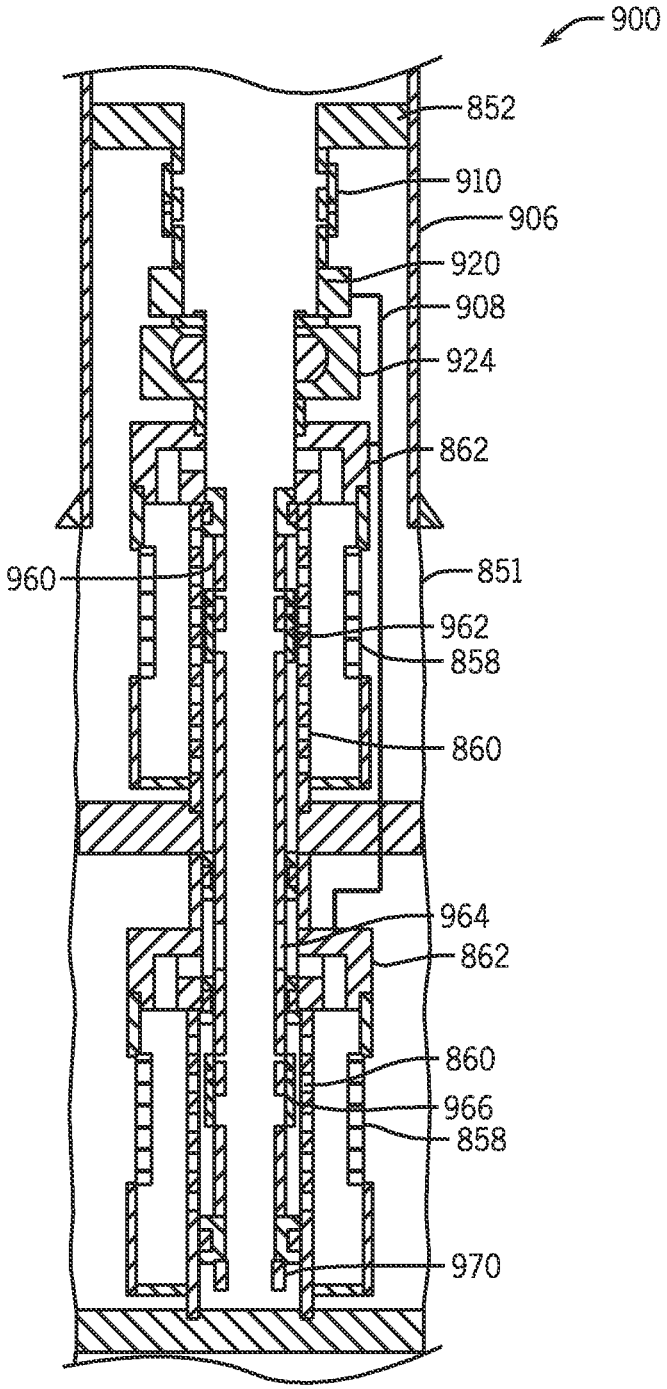
FIG. 17 is a schematic diagram of the lower completion assembly of FIG. 15 after a straddle seal isolation assembly is run into the lower completion assembly according to an example implementation.

Referring to FIG. 17, in accordance with some implementations, an isolation straddle seal assembly 960 may be run downhole inside the lower completion assembly 900 to prepare the assembly 900 for the production phase. Similar to the isolation seal assemblies disclosed above, the isolation seal assembly 960 includes ports 961 and 964, which align with corresponding outlets of the flow control valves 862. The isolation straddle seal assembly 960 further includes valves 962 and 966 (sliding sleeve valves, for example), which may be operated for purposes of selectively establishing alternative paths through the screen assemblies should the flow control valves 862 not function properly. In this manner, the valves 962 and 966 may be operated by a shifting tool on a string that is run inside the isolation straddle seal assembly 960, in accordance with some implementations.

Figure 18:
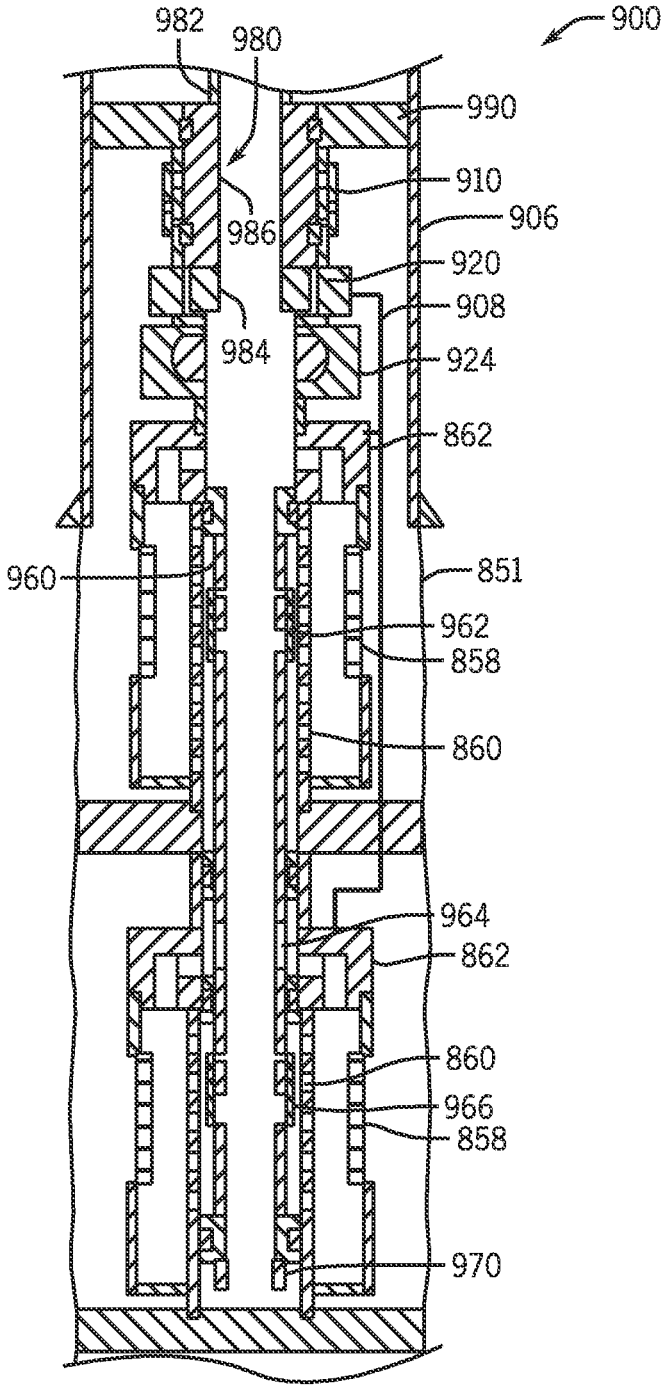
FIG. 18 is an illustration of an upper completion assembly and the lower completion assembly of FIG. 15 according to an example implementation.

FIG. 18 depicts the installation of an upper completion assembly 980 and the mating of the assembly 980 with the lower completion assembly 900. As shown, for this implementation, the upper completion assembly 980 includes an isolation seal section 986, which isolates the port control valve 985. Moreover, the lower end of the upper completion 980 may include an inductive coupler 984 for purposes of inductively coupling wire of an electric cable 991 to corresponding wires of the lower completion assembly 900 (wires extending to the flow control valves 862, for example). Alternatively, in further implementations, the lower end of the upper completion assembly 980 may include a wet connect hydraulic coupler as well as may include both hydraulic wet connect couplers and inductive couplers. Thus, many variations are contemplated, which are within the scope of the appended claims.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

running a lower completion assembly into a well in a single trip, the lower completion assembly comprising a screen, a first valve and a second valve;

after the running of the lower completion assembly into the well, performing a gravel packing operation using the assembly, the performing comprising communicating a gravel packing slurry and running a service assembly into the lower completion assembly to operate the first valve to communicate fluid from the gravel packing slurry into a central passageway of the lower completion assembly;

removing the service assembly from the well; and subsequently installing an upper completion assembly in the well, the installing comprising enabling remote control of the second valve to regulate production of fluid from the well.

2. The method of claim 1, wherein the installing comprises establishing a control communication connection between the lower completion assembly and the upper completion assembly, the control communication connection selected from a group consisting of a hydraulic communication connection, an electrical communication connection and a fiber optic communication connection.

3. The method of claim 1, wherein the screen comprises an upper end and a lower end, the method further comprising disposing the second valve closer to the upper end of the screen than to the lower end of the screen.

4. The method of claim 1, further comprising disposing the second valve such that the flow enters the second valve after the flow passes through the screen assembly.

5. The method of claim 4, wherein the second valve has a flow shroud to direct the flow after it passes through screen to the second valve.

6. The method of claim 1, further comprising controlling the second valve from an Earth surface of the well to control production of fluid from the well.

7. The method of claim 1, further comprising running an isolation seal assembly into the lower completion assembly to prevent leakage from occurring through the circulation valve after a gravel packing operation.

8. The method of claim 7, further comprising running a shifting tool at the lower end of the isolation seal assembly into the lower completion assembly to open the second valve.

9. An apparatus usable with a well, comprising:

a lower completion assembly comprising a screen, a first valve and a second valve adapted to be run downhole as a unit, wherein:

the first valve to be controlled by a service tool run into the lower completion assembly after installation of the lower completion assembly in the well and before installation of an upper completion assembly in the well; and the second valve is adapted to be controlled in response to one or more stimuli communicated downhole via at least one control line of the upper completion assembly.

10. The apparatus of claim 9, wherein the lower completion assembly further comprises a circulation valve adapted to communicate a gravel slurry from an interior space of the lower completion assembly into an annular space outside of the screen, wherein a fluid from the gravel slurry is adapted to enter the completion assembly in a communication path that extends through the screen and through the first valve.

11. The apparatus of claim 9, wherein the second valve comprises a valve from a plurality of cartridge valves arranged around a peripheral region of the lower completion assembly.

12. The apparatus of claim 9, wherein the lower completion assembly further comprises a packer to be set inside a casing section of a well, the screen comprises one of a plurality of screens adapted to extend into an uncased segment of the well, and the lower completion assembly further comprising an open hole isolation packer adapted to be set inside the uncased well segment.

13. The apparatus of claim 9, wherein the lower completion assembly comprises a packer adapted to be set inside a cased segment of a well and the screen is adapted to extend into an uncased segment of the well, the lower completion assembly further comprising a formation isolation valve adapted to be operated to selectively control fluid communication through the lower completion assembly, the lower completion assembly further comprising a washpipe comprising a tool to operate the formation isolation valve.

14. The apparatus of claim 9, wherein the lower completion assembly further comprises at least one packer.

15. The apparatus of claim 9, wherein the lower completion assembly further comprises:

at least one additional valve adapted to be controlled by the service tool run into the lower completion assembly before installation of an upper completion assembly, and at least one additional valve is adapted to be controlled in response to stimuli communicated downhole via the at least one control line of the upper completion assembly.

16. The apparatus of claim 9, wherein the lower completion assembly further comprises a control line coupler to couple at least one control line of an upper completion assembly with the second valve.

17. The apparatus of claim 9, wherein the lower completion assembly further comprises an interior base pipe to extend inside the screen to create an annular space about the base pipe to receive fluid communicated through the screen, and the first valve and the second valve are each adapted to selectively regulate communication of fluid between the annular space and an interior space of the base pipe.

18. The apparatus of claim 17, wherein the lower completion assembly further comprises a sub adapted to form a sealed connection for a control line that extends outside of the annular space and into the annular space to communicate a control stimulus to the second valve.

19. The apparatus of claim 9, wherein the screen has a first inner diameter and the lower completion assembly further comprises a radially expanded housing having a second inner diameter greater than the first inner diameter.

20. The apparatus of claim 9, wherein the screen comprises an upper end and a lower end, the first valve is disposed closer to the lower end of the screen than to the upper end of the screen, and the second valve is disposed closer to the upper end of the screen than to the lower end of the screen.

21. The apparatus of claim 9, wherein the second valve is part of a plurality of valves disposed about a periphery of the lower completion assembly and adapted to be controlled in response to stimuli communicated downhole via the at least one control line or electric line of the upper completion assembly.

22. The apparatus of claim 9, wherein the second valve is adapted to establish a plurality of flow control settings in which fluid is communicated through a flow passageway of the second valve.

23. The apparatus of claim 9, wherein the lower completion assembly further comprises:

packers to be set to create an isolated zone; and a plurality of valves adapted to be controlled in response to the stimuli communicated downhole via the at least one control line of the upper completion assembly, wherein the second valve comprises one of the plurality of valves, and the plurality of valves are longitudinally distributed along the zone.

24. The apparatus of claim 9, further comprising:

an isolation assembly adapted to be run inside the lower completion assembly to isolate fluid communication through a port control valve of the lower completion assembly.

25. The apparatus of claim 24, wherein the isolation assembly comprises a port aligned with the second valve to permit fluid communication through the second valve and the port.

26. The apparatus of claim 24, wherein the isolation seal assembly further comprises a third valve to provide a backup flow path for the second valve after the first valve transitions from being closed.

27. The apparatus of claim 26, wherein the isolation seal assembly further comprises a tool to open the first valve upon installation of the isolation seal assembly to permit the third valve to selectively control fluid communication through the first valve and the third valve.

28. An apparatus comprising:

a lower completion assembly comprising a plurality of sections adapted to run downhole in a single trip into a well, wherein the lower completion assembly is adapted to be used during a gravel packing phase to deposit gravel about at least one of the sections and mate with an upper completion assembly after the gravel packing phase to regulate production in a production phase, at least one of the sections comprising:

a screen, a packer, a first valve, a second valve and a circulation valve, wherein:

the lower completion assembly to receive a service tool run downhole after the lower completion assembly during the gravel packing phase to communicate a gravel slurry and operate the first valve to regulate delivery of the gravel, and the second valve is adapted to be controlled in response to one or more stimuli communicated downhole via at least one control line of the upper completion assembly during the production phase.

29. The apparatus of claim 28, wherein the at least one section further comprises an interior base pipe to extend inside the screen to create an annular space about the base pipe to received fluid communicated through the screen, the first valve and the second valve are each adapted to selectively regulate communication of fluid between the annular space and an interior space of the base pipe, and the at least one section further comprises a sub adapted to form a sealed connection for a control line that extends outside of the annular space and into the annular space to communicate a control stimulus to the second valve.

* * * * *